US010985474B2

(12) United States Patent
Osenga et al.

(10) Patent No.: US 10,985,474 B2
(45) Date of Patent: Apr. 20, 2021

(54) GROUNDING CONNECTOR WITH LOCK JOINT

(71) Applicant: Panduit Corp., Tinley Park, IL (US)

(72) Inventors: David K. Osenga, Independence, KY (US); Robert G. Bucciferro, Shorewood, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/531,589

(22) Filed: Aug. 5, 2019

(65) Prior Publication Data

US 2020/0044368 A1 Feb. 6, 2020

Related U.S. Application Data

(60) Provisional application No. 62/714,930, filed on Aug. 6, 2018.

(51) Int. Cl.
*H01R 4/18* (2006.01)
*H01R 4/64* (2006.01)

(52) U.S. Cl.
CPC ..... *H01R 4/186* (2013.01); *H01R 4/646* (2013.01)

(58) Field of Classification Search
None
See application file for complete search history.

(56) References Cited

U.S. PATENT DOCUMENTS 918,078 A * 4/1909 McCaffrey ..... F16D 1/06 403/344
2,884,478 A * 4/1959 Becker ..... H01R 4/186 174/94 R
D187,531 S * 3/1960 Klosin ..... D13/149
2,956,108 A 10/1960 Brenner
2,964,585 A * 12/1960 Nilsson ..... H01R 4/186 174/94 R
3,009,987 A * 11/1961 Brenner ..... H01R 4/186 174/94 R
3,022,370 A * 2/1962 Osborn ..... H01R 4/186 174/71 R
3,023,036 A * 2/1962 Taylor, Jr. ..... E21B 37/02 403/344
3,053,930 A * 9/1962 Mallanik ..... H01R 4/186 174/94 R
3,088,993 A * 5/1963 Matthysse ..... H01R 4/186 174/71 R
3,183,025 A * 5/1965 Lynch, Jr. ..... F16G 11/02 403/390
3,235,654 A * 2/1966 Eldridge, Jr. ..... H01R 4/186 174/94 R
3,236,938 A * 2/1966 Toedtman ..... H01R 4/186 174/94 R (Continued)

*Primary Examiner* — Binh B Tran
*Assistant Examiner* — Muhammed Azam
(74) *Attorney, Agent, or Firm* — Christopher S. Clancy; James H. Williams; Peter S. Lee

(57) ABSTRACT

A grounding connector has a body including a first side, a second side, and a mid-section extending therebetween, with an opening extending through the body from the first side to the second side. The body of the grounding connector includes a lock joint configured to join the grounding connector with a second grounding connector, with the lock joint including a recess inset into the mid-section of the body and a protrusion adjacent the recess extending from the mid-section.

16 Claims, 11 Drawing Sheets

(56) References Cited

U.S. PATENT DOCUMENTS 3,251,615 A * 5/1966 Short, III ..... F16L 17/04 285/112
3,322,888 A * 5/1967 Zemels ..... H01R 4/186 174/94 R
3,330,903 A * 7/1967 Holke ..... H01R 4/186 174/94 R
3,340,352 A * 9/1967 Teagno ..... H01R 4/186 174/94 R
3,354,517 A * 11/1967 Levinsky ..... H01R 4/186 403/275
3,387,080 A * 6/1968 Dibble ..... H01R 4/186 174/94 R
3,408,455 A * 10/1968 Dannes ..... H01R 4/186 174/94 R
3,546,366 A * 12/1970 Toedtman ..... H01R 4/186 174/94 R
3,588,791 A * 6/1971 Polidori ..... H01R 4/5083 439/783
3,746,777 A * 7/1973 Peek ..... H01R 4/186 174/94 R
3,757,031 A * 9/1973 Izraeli ..... H02G 15/113 174/138 F
3,781,459 A * 12/1973 Peek ..... H01R 4/186 174/94 R
3,916,517 A * 11/1975 Luongo ..... H01R 4/186 29/874
4,165,148 A * 8/1979 Campbell ..... H01R 43/0585 174/94 R
4,201,433 A * 5/1980 Caldwell ..... H01R 4/646 439/98
4,350,843 A * 9/1982 Campbell ..... H01R 4/186 174/84 C
4,373,235 A * 2/1983 Korgaonkar ..... F16L 23/04 24/282
4,384,753 A * 5/1983 Mixon, Jr. ..... H01R 4/646 439/435
4,940,856 A * 7/1990 Bock ..... H01R 4/186 174/84 C
4,950,838 A * 8/1990 Gordon ..... H01R 4/186 174/71 R
5,007,666 A * 4/1991 Kyfes ..... B29C 65/58 138/162
5,036,164 A * 7/1991 Schrader ..... H01R 4/186 174/94 R
5,103,068 A * 4/1992 Schrader ..... H01R 4/186 174/71 R
5,151,560 A * 9/1992 Kreinberg ..... H01R 4/26 174/78
5,162,615 A * 11/1992 Schrader ..... H01R 4/186 174/71 R
5,200,576 A * 4/1993 Schrader ..... H01R 4/186 174/71 R
5,396,033 A * 3/1995 Piriz ..... H01R 4/186 174/71 R
5,449,206 A * 9/1995 Lockwood ..... F16L 11/18 138/120
5,552,564 A * 9/1996 Schrader ..... H01R 4/186 174/84 C
5,898,131 A * 4/1999 Chadbourne ..... H01R 43/0427 174/84 C
5,911,585 A * 6/1999 Zwit ..... H01R 4/643 439/100
6,004,165 A * 12/1999 Dinh ..... H01R 4/5083 439/782
6,303,861 B1 * 10/2001 Dobrinski ..... H01R 4/186 174/5 SG
6,452,103 B1 * 9/2002 Piriz ..... H01R 4/186 174/71 R
6,486,403 B1 * 11/2002 Connor ..... H01R 4/186 174/84 C
6,525,270 B1 * 2/2003 Connor ..... H01R 4/186 174/84 C
6,747,211 B2 6/2004 Connor et al.
6,818,830 B2 11/2004 O'Grady et al.
7,026,552 B2 4/2006 Sokol et al.
7,053,307 B2 5/2006 Kossak et al.
7,121,001 B2 10/2006 O'Grady et al.
7,165,436 B2 * 1/2007 Bitz ..... H01R 4/186 29/751
7,183,489 B2 2/2007 Kossak et al.
7,301,098 B2 * 11/2007 Bolouri-Saransar ... H01B 11/16 174/113 R
7,466,891 B2 * 12/2008 Wagner ..... G02B 6/3802 385/134
7,492,996 B2 2/2009 Kowalczyk et al.
7,511,224 B1 * 3/2009 Kossak ..... H01R 4/186 174/84 R
7,655,863 B2 2/2010 Kossak
D615,497 S 5/2010 Woodward et al.
9,166,353 B1 * 10/2015 Doornbos ..... H01R 43/048
10,297,942 B1 * 5/2019 Gauthier ..... H01R 25/145
2002/0098745 A1 * 7/2002 Triantopoulos ..... H01R 4/186 439/877
2003/0010522 A1 * 1/2003 Connor ..... H01R 4/20 174/84 C
2003/0010523 A1 * 1/2003 Connor ..... H01R 4/20 174/84 C
2003/0010524 A1 * 1/2003 Connor ..... H01R 4/186 174/84 C
2004/0074666 A1 * 4/2004 O'Grady ..... H01R 4/186 174/84 C
2004/0108129 A1 * 6/2004 Sokol ..... H01R 4/186 174/84 C
2005/0098341 A1 * 5/2005 Kossak ..... H01R 4/186 174/84 C
2006/0201695 A1 * 9/2006 Kossak ..... H01R 4/186 174/84 R
2009/0250508 A1 * 10/2009 Sokol ..... H01R 4/186 228/208
2009/0260875 A1 * 10/2009 Kossak ..... H01R 4/186 174/84 C
2012/0222718 A1 * 9/2012 Sweeney ..... H01R 4/38 136/244
2014/0262437 A1 * 9/2014 Dinh ..... H02G 1/14 174/135
2014/0273560 A1 * 9/2014 Cawood ..... H01R 4/187 439/98
2015/0072574 A1 * 3/2015 McGann ..... H01R 11/01 439/879
2015/0087171 A1 * 3/2015 Siebens ..... H01R 4/646 439/108
2015/0263438 A1 * 9/2015 Dinh ..... H01R 4/186 174/84 C
2018/0248274 A1 * 8/2018 Lindkamp ..... H01R 4/20
2019/0058265 A1 * 2/2019 Robicheau ..... H01R 4/184
2020/0044368 A1 * 2/2020 Osenga ..... H01R 4/646

* cited by examiner

GROUNDING CONNECTOR WITH LOCK JOINT

CROSS REFERENCE TO RELATED APPLICATIONS

This application claims priority to U.S. Provisional Application No. 62/714,930, filed Aug. 6, 2018, the subject matter of which is hereby incorporated by reference in its entirety.

FIELD OF THE INVENTION

The present invention relates to a grounding connector for connecting two conductive elements together.

BACKGROUND OF THE INVENTION

Grounding compression connectors, also referred to as Figure 8 connectors, are used for connecting wire to grounding rods. Figure 8 connectors typically include a solid copper extrusion that form two seamless rings of copper. These Figure 8 connectors are typically manufactured using extrusion molding, thereby forming a unitary piece of copper configured in a Figure 8 shape.

To install a Figure 8 connector, a wire is inserted into one of the rings and a grounding rod is inserted into the other ring. The Figure 8 connector is then crimped to secure the wire and grounding rod in place and form an electrical grounding path. An example of an existing Figure 8 grounding connector is the Ground Rod Tap Connectors sold by Thomas & Betts.

Different combinations of Figure 8 connectors must be manufactured to accommodate different sizes of wire and grounding rods within the rings. As such, Figure 8 connectors must be manufactured with a range of different sized rings for the wire, paired with a range of different sized rings for the grounding rod. To accomplish this, a manufacturer must individually tool for manufacturing, each of the Figure 8 connector combinations. Similarly, an installer must have each combination of sizes on-hand when utilizing a Figure 8 connector in order to ensure the correct ring size for the wire and grounding rod combination.

SUMMARY OF THE INVENTION

In one example, according to the teachings of the present invention, a grounding connector for securing a wire or rod therein may comprising a body including a first side and a second side and a mid-section extending therebetween, with an opening extending through the body from the first side to the second side, and with the body including a lock joint configured to join the grounding connector with a second grounding connector, the lock joint including a recess inset into the mid-section of the body and a protrusion adjacent the recess extending from the mid-section.

In one example, the lock joint of the grounding connector may be configured to slidably connect to a second grounding connector.

In one example, the opening of the grounding connector may be configured to accept a wire or rod.

In one example, the grounding connector may be configured to deform and reduce the diameter across at least a portion of the opening for securing the wire or rod therein.

In one example, the protrusion of the grounding connector may include a first outer wall extending from the body, an inner wall extending from the body, and a first base wall extending therebetween, with a first distance between the first outer wall and the inner wall along the base wall being greater than a second distance between the outer wall and the inner wall along the body.

In one example, the recess of the grounding connector may include a second outer wall extending into the body, the inner wall of the protrusion, and a second base wall extending therebetween, with a third distance between the second outer wall and the inner wall along the second base wall being greater than a fourth distance between the second outer wall and the inner wall along adjacent the second base wall.

In one example, according to the teachings of the present invention, a compression connector for securing wires or rods therein may comprising a first grounding connector including a body including a first side and a second side and a mid-section extending between, with an opening that extends through the body from the first side to the second side and the body including a first lock joint, and a second grounding connector may include a body including a first side and a second side and a mid-section extending between, with an opening that extends through the body from the first side to the second side and the body including a second lock joint; the first lock joint of the first grounding connector is removably mated to the second lock joint of the second grounding connector.

In one example, the opening of first grounding connector is larger than the opening of the second grounding connector.

In one example, the first and second lock joints of the compression connector may include a protrusion and a recess.

In one example, the protrusions of the compression connector extend out from the body and the recess resides within the body.

In one example, the first lock joint and second lock joint of the compression connector are configured to slidably mate.

In one example, the first lock joint of the first grounding connector may include a first recess inset into a mid-section of the body and a first protrusion adjacent the first recess extending from the mid-section.

In one example, the second lock joint of the second grounding connector may include a second recess inset into a mid-section of the body and a second protrusion adjacent the second recess extending from the mid-section.

In one example, the first protrusion and second protrusion of the compression connector may each include a first outer wall extending from the body, an inner wall extending from the body, and a first base wall extending therebetween, where a first distance between the first outer wall and the inner wall along the base wall is greater than a second distance between the outer wall and the inner wall along adjacent the second base wall.

In one example, the first recess and second recess of the compression connector may each include a second outer wall extending into the body, the inner wall of the protrusion, and a second base wall extending therebetween, where a third distance between the second outer wall and the inner wall along the second base wall is greater than a fourth distance between the second outer wall and the inner wall along the body.

In one example, according to the teachings of the present invention, a method of forming a compression connector may comprising joining a first lock joint of a first grounding connector to a second lock joint of a second grounding connector, inserting a wire into an opening in the first grounding connector, inserting a rod into an opening in the second grounding connector, crimping the joined first grounding connector and second grounding connector, and deforming the first grounding connector and the second grounding connector, thereby locking the first grounding connector to the second grounding connector and securing the wire and grounding rod in place.

BRIEF DESCRIPTION OF THE DRAWINGS

Objects, features, and advantages of the present invention will become apparent upon reading the following description in conjunction with the drawing figures in which.

DETAILED DESCRIPTION

The disclosed grounding connector solves or improves upon one or more of the above noted and/or other problems and disadvantages with prior products and methods. The grounding connector of the present invention forms a grounding connector with a symmetrical locking feature that is configured to mate with a variety of sized grounding connectors including the locking feature. This enables grounding connectors with the same or different opening size to be mated together. The grounding connector simplifies the manufacture and installation of connecting a wire to a grounding rod or wire. The grounding connector of the present invention reduces the overall extrusion profile of the grounding connector during the manufacturing process. The grounding connector reduces the number of different size combinations needed to manufacture a connector. Further, the present invention reduces the number of different combinations of Figure 8 connector sizes that an installer must have on hand to join a wire and rod.

Figure 1:
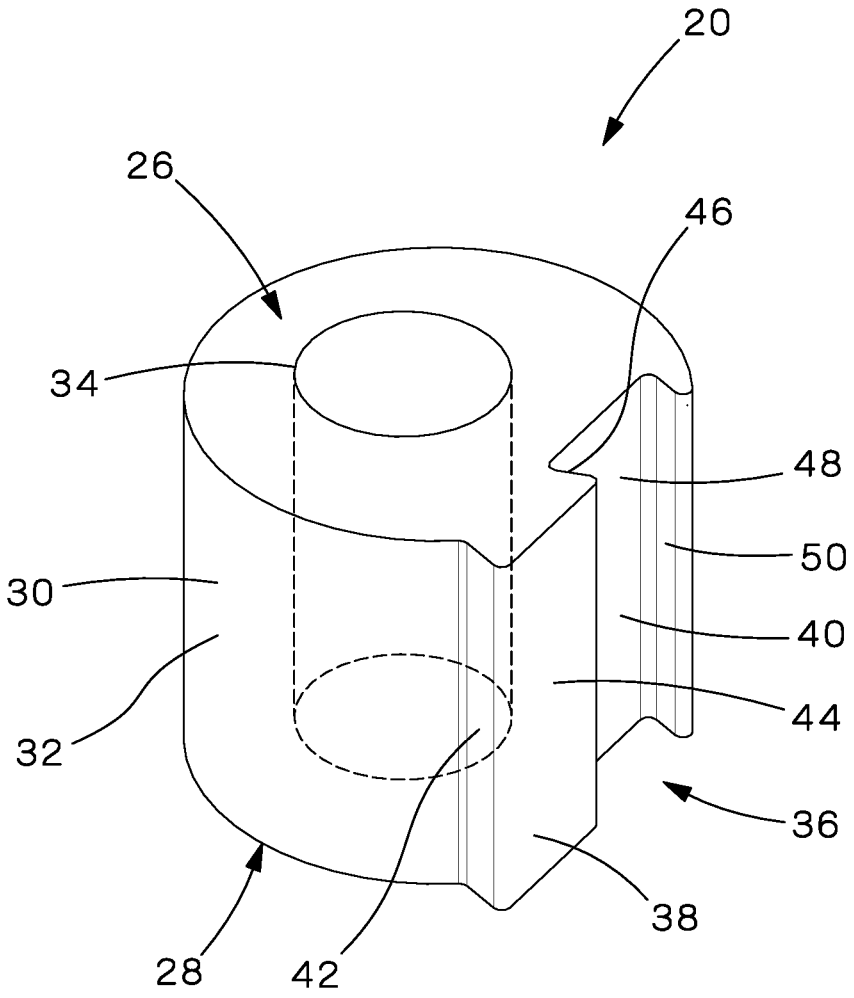
FIG. 1 depicts a top perspective view of an example grounding connector.

Turning to the drawings, FIG. 1 depicts one example of a grounding connector 20. The grounding connector 20 includes a first side 26, a second side 28, and a mid-section or side wall 30 extending therebetween. The first side 26 and second side 28 are planar surfaces with a C-shaped configuration. The side wall 30 is curved about the perimeter of the first side 26 and second side 28. The first side 26, second side 28, and side wall 30 form the body 32 of the grounding connector 20.

The body 32 of the grounding connector 20 includes a through opening 34. The opening 34 extends from the first side 26 to the second side 28. The size of the opening 34 is configured to accept a wire or grounding rod as described in relation to FIGS. 9 and 10 below.

The grounding connector 20 further includes a lock joint 36. The lock joint 36 includes the combination of a protrusion 38 and a recess 40. The protrusion 38 is disposed on the side wall 30 from the first side 26 to the second side 28. The protrusion 38 includes an outer wall 42 that extends out and away at an angle from the body 32 and side wall 30. A base wall 44 is disposed at an end of the outer wall 42. The base wall 44 extends across the body 32 of the grounding connector 20. An end of the base wall 44, opposite the outer wall 42, is an inner wall 46. The inner wall 46 extends between the base wall 44 and the body 32 at an angle. The angle of the outer wall 42 and inner wall 46 are mirrored walls including the same angle of extension away from the body 32.

The distance between the outer wall 42 and the inner wall 46 along the base wall 44 is greater than the distance between the outer wall 42 and the inner wall 46 along the body 32. The configuration of the outer wall 42, base wall 44, and inner wall 46 form a cross-sectional shape of a trapezoid.

Directly adjacent the protrusion 38 on the body 32 is the recess 40. The inner wall 46 of the protrusion 38 is shared with the recess 40. The recess 40 includes the inner wall 46 of the protrusion, which extends to a base 48. The base 48 extends across a portion of the body 32 to an outer wall 50 of the recess 40. The outer wall 50 extends outward at an angle from the base 48 to the side wall 30.

The distance between the outer wall 50 and the inner wall 46 along the base 48 is greater than the distance between the outer wall 50 and the inner wall 46 along the body 32. The configuration of the outer wall 50, base wall 48, and inner wall 46 form a cross-sectional shape of a trapezoid.

The shape and dimensions of the protrusion 38 are configured to correspond to the recess 40. The size and shape of the protrusion 38 of one grounding connector 20 is configured to allow the protrusion 38 to mate with the recess 40 of another grounding connector 20. This configuration allows the grounding connector 20 to be symmetrical and mate with another grounding connector 20 with the same lock joint 36 configuration.

Figure 2:
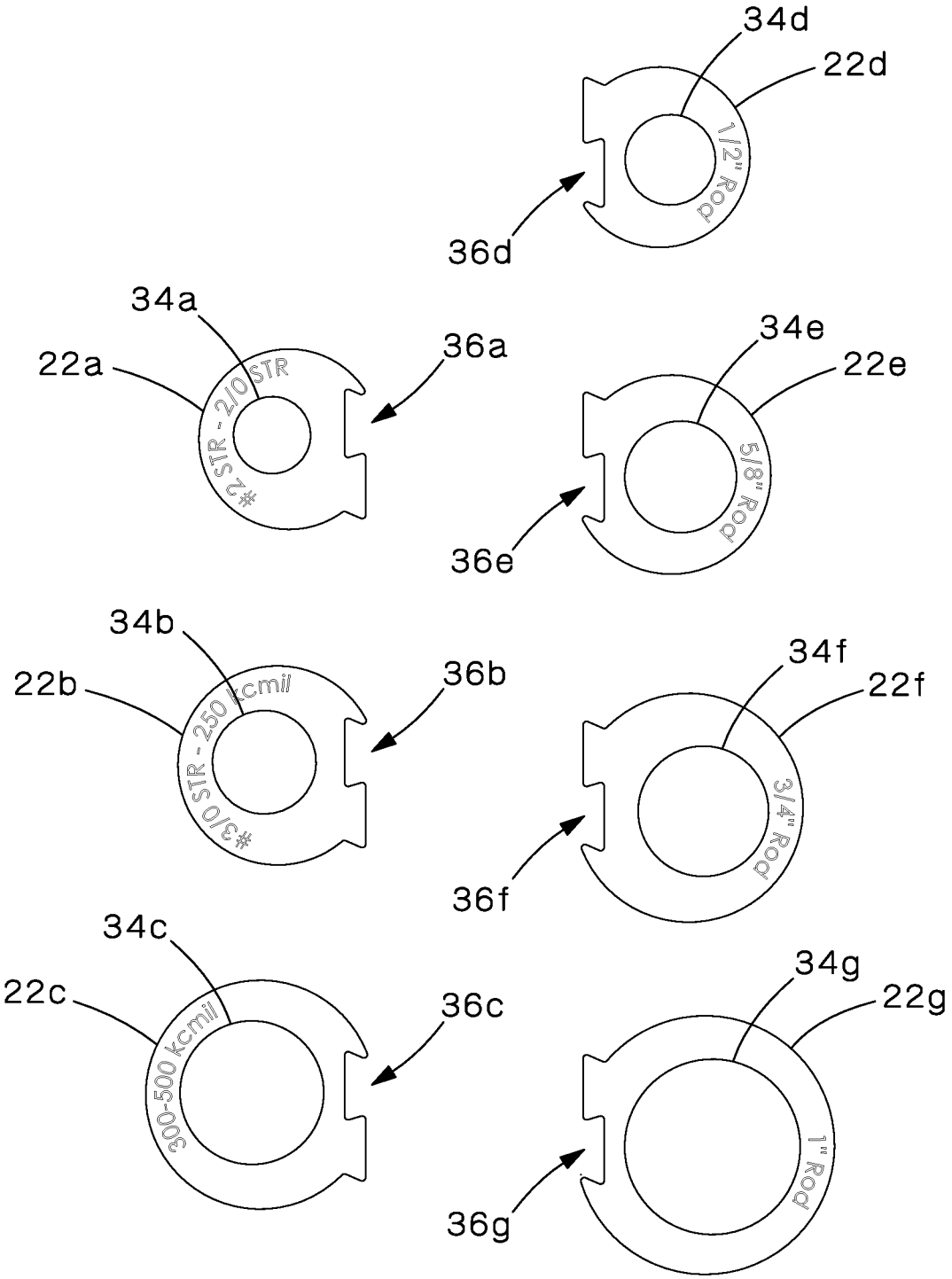
FIG. 2 depicts a top view of a plurality of differently sized grounding connectors.

FIG. 2 depicts several differently sized grounding connectors 22*a*-22*g*. Each of the grounding connectors 22*a*-22*g* include the opening 34 and lock joint 36 as described above in relation to the grounding connector of FIG. 1. Grounding connectors 22*a*-22*c* may be configured to accept a wire. Grounding connectors 22*d*-22*g* may be configured to accept a grounding rod or wire.

As depicted in FIG. 2, grounding connectors 22*a*-22*c* are configured with different sized openings 34 in order to receive a variety of wire sizes. Grounding connector 22*a* may be configured with an opening 34*a* to accept a #2-gauge wire. In this instance, the opening 22*a* may be in the range of 0.2 inches to 0.4 inches in diameter. Grounding connector 22*b* may be configured with an opening 34*b* to accept a #3/0-gauge wire. In this instance, the opening 34*b* may be in the range of 0.4 inches to 0.75 inches in diameter. Grounding connector 22*c* may be configured with an opening 34*c* to accept a 300-500 kcmil wire. In this instance, the opening 22*c* may be in the range of 0.5 inches to 1 inches in diameter.

Further depicted in FIG. 2 are grounding connectors 22*d*-22*g*, which are configured with different sized openings 34 configured to receive a variety of rods. Grounding connector 22*d* may be configured with an opening 34*d* to accept a ½ inch rod. In this instance, the opening 34*d* may be in the range of 0.25 inches to 0.75 inches in diameter. Grounding connector 22*e* may be configured with an opening 34*e* to accept a ⅝ inch rod. In this instance, the opening 34*e* may be in the range of 0.375 inches to 0.875 inches in diameter. Grounding connector 22*f* may be configured with an opening 34*f* to accept a ¾ inch rod. In this instance, the opening 34*f* may be in the range of 0.5 inches to 1 inches in diameter. Grounding connector 22*g* may be configured with an opening 34*g* to accept a 1 inch rod. In this instance, the opening 34*g* may be in the range of 0.75 inches to 1.25 inches in diameter.

For grounding connectors 22*a*-22*g*, as the openings 34*a*-34*g* get larger to accommodate larger wires or rods, the body 32*a*-32*g* is enlarged to provide for sufficient material to support the opening 34*a*-34*g*. It is contemplated that a wall thickness 52 between the range of 0.125 to 0.3 inches may be maintained to provide sufficient material for the opening 34.

Despite the size of the body 32*a*-32*g* of each grounding connector 22*a*-22*g* in FIG. 2, the size of the lock joints 36 remain the same for each grounding connector 22*a*-22*g*, such that any of the lock joints 36*a*-36*g* of each of grounding connectors 22*a*-22*g* may mate with any other lock joint 36*a*-36*g* of grounding connectors 22*a*-22*g*. This allows any sized grounding connector 22*a*-22*g* to be interchangeably connected with another grounding connector 22*a*-22*g*.

Figure 3:
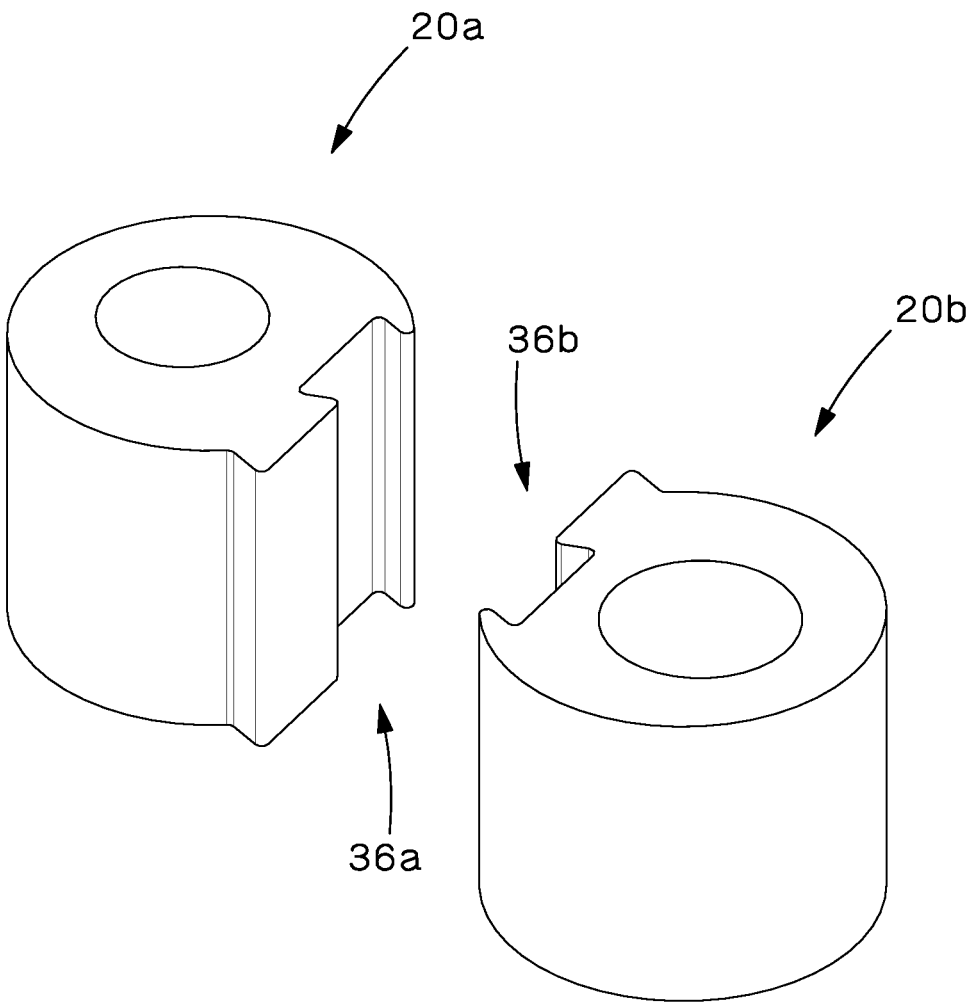
FIG. 3 depicts a top perspective view of two offset grounding connectors of the grounding connector of FIG. 1.

FIG. 3 depicts two grounding connectors 20*a*, 20*b*. The grounding connectors 20*a*, 20*b* are each the same grounding connectors as the grounding connector 20 of FIG. 1. Grounding connector 20*b* has been orientated 180 degrees from grounding connector 20*a*. As such, the locking joints 36*a*, 36*b* of the grounding connectors 20*a*, 20*b* of FIG. 3 are aligned to mate.

Figure 4:
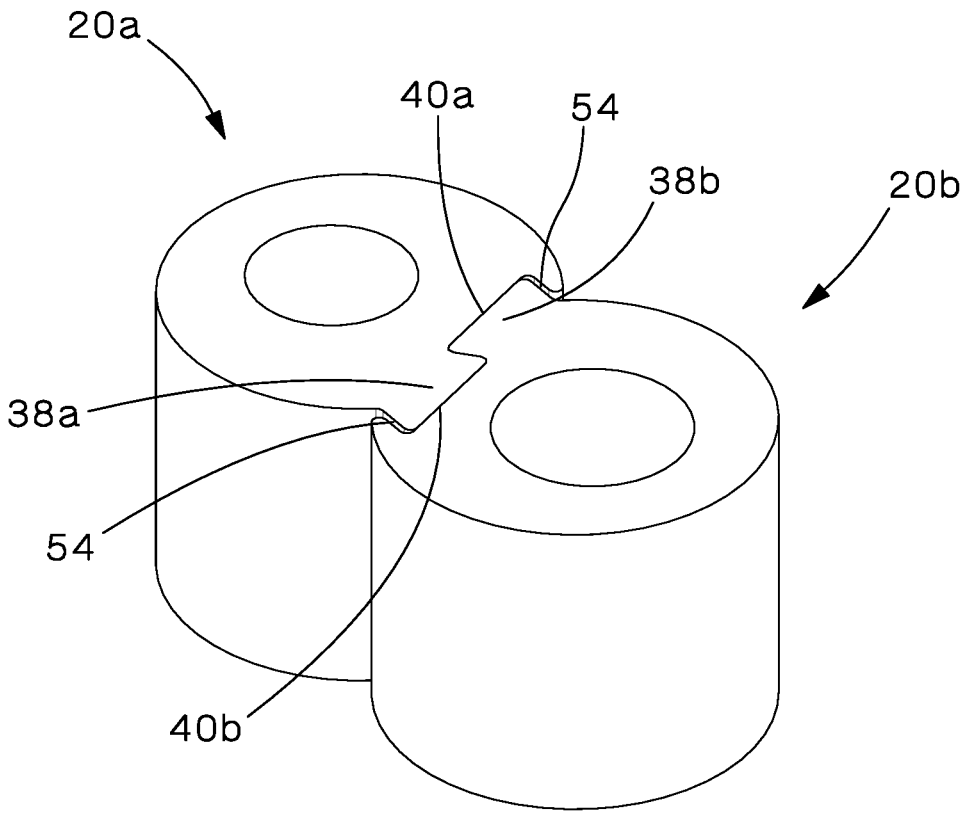
FIG. 4 depicts a top perspective view of two mated grounding connectors.

FIG. 4 depicts the grounding connectors 20*a*, 20*b* of FIG. 3 in a mated configuration. The protrusion 38*a* of grounding connector 20*a* is retained within the recess 40*b* of grounding connector 20*b*. Further, the protrusion 38*b* of grounding connector 20*b* is retained within the recess 40*a* of grounding connector 20*a*. The fit between the protrusions 38*a*, 38*b* and corresponding recess 40*a*, 40*b* may be configured to be a snug fit, but with sufficient allowance 54 between the protrusions 38*a*, 38*b* and the recesses 40*a*, 40*b*. The allowance 54 enables the grounding connectors 20*a*, 20*b* to be mated in a slidable connection.

Figure 5:
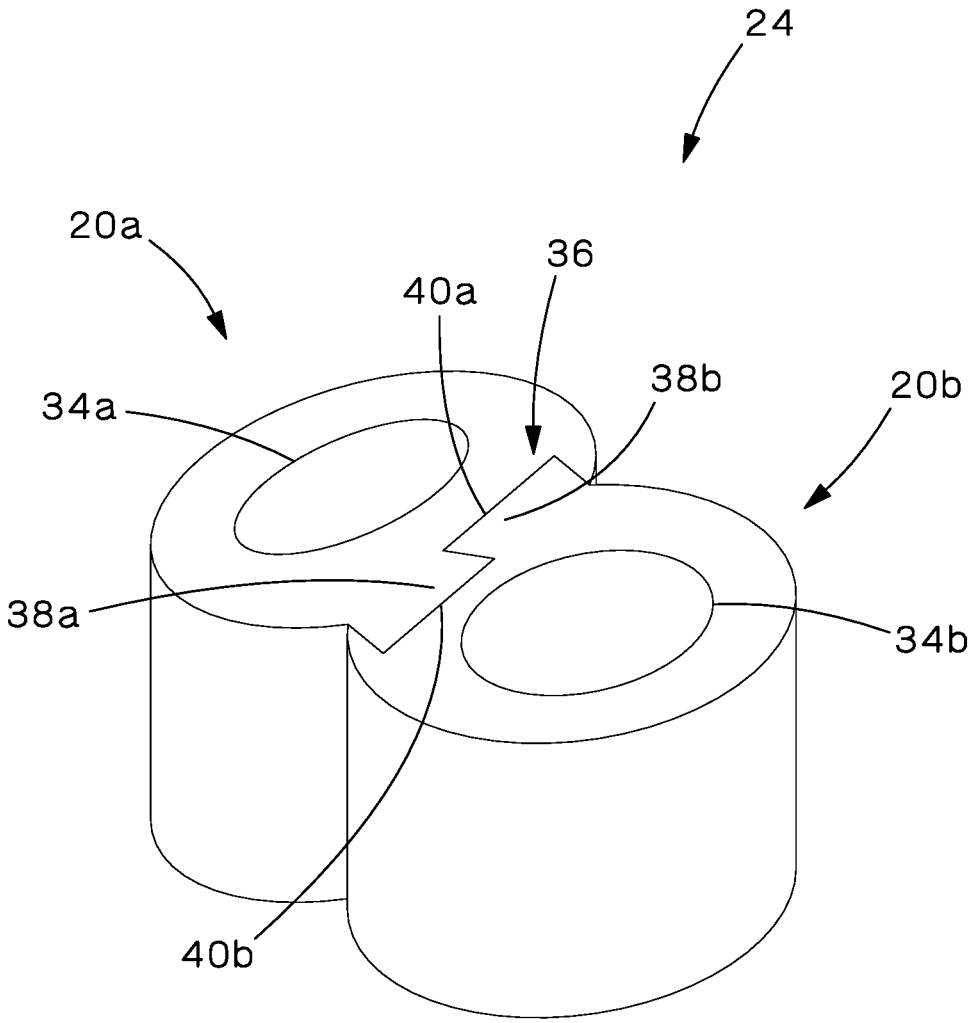
FIG. 5 depicts a top perspective view of two crimped grounding connectors.

FIG. 5 depicts the grounding connectors 20*a*, 20*b* of FIG. 4 in a crimped and deformed configuration. In this configuration, the grounding connectors 20*a*, 20*b* have been compressed and deformed. The mated grounding connectors 20*a*, 20*b* are configured to be crimped in order to fix a wire or rod in place within the opening 34*a*, 34*b* of each grounding connector 20*a*, 20*b*. As depicted in FIG. 5, the openings 34*a*, 34*b* in each grounding connector 20*a*, 20*b* has been deformed to be elliptical in shape and to reduce the diameter across at least a portion of the opening 34*a*, 34*b*.

Further depicted in FIG. 5, is the interaction of the lock joints 36 of the grounding connectors 20*a*, 20*b* when the grounding connectors 20*a*, 20*b* are crimped together. Crimping the connectors 20*a*, 20*b* together also deforms the protrusions 38 within the recesses 40 of the lock joints 36. This deformation eliminates the allowance 54 of the lock joints 36 depicted in FIG. 4 of the grounding connectors 20*a*, 20*b*. The deformed protrusions 38 within the recesses 40 of FIG. 5 fix the grounding connectors 20*a*, 20*b* together to form a unitary grounding compression connector 24.

Figure 6A:
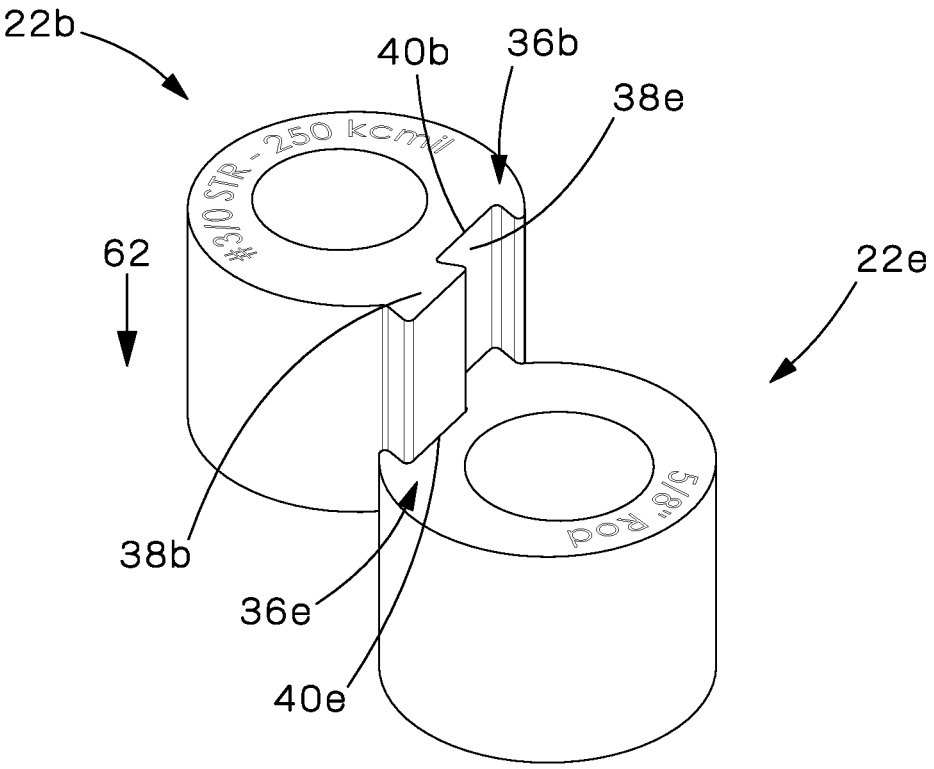
FIG. 6A depicts a top perspective view of two offset grounding connectors being slidably connected.
Figure 6B:
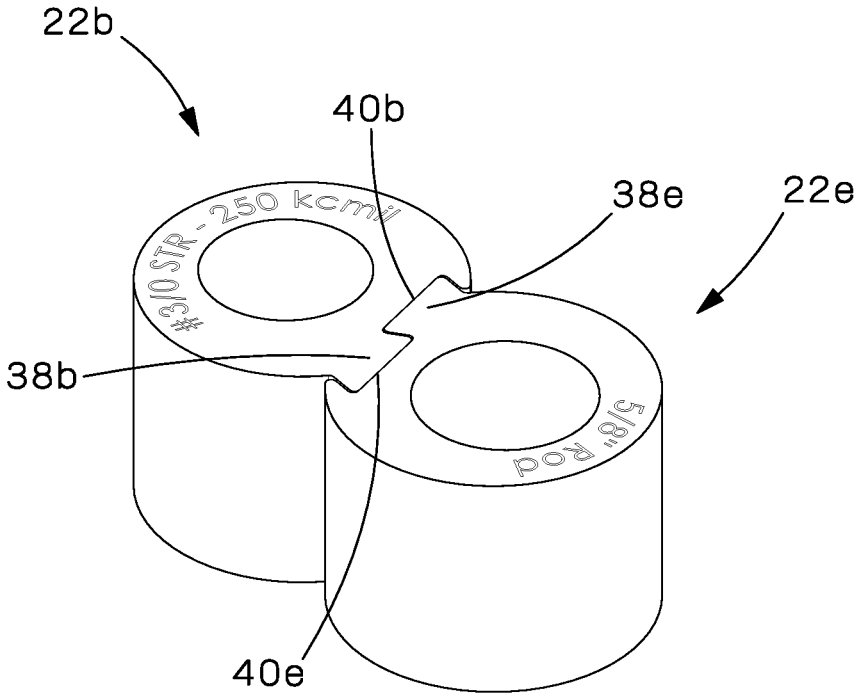
FIG. 6B depicts the grounding connectors of FIG. 6A in a mated configuration.

FIGS. 6A and 6B depict the assembling of two grounding connectors 22*b*, 22*e* of FIG. 2. The lock joint 36*b* of grounding connector 22*b* is aligned within the lock joint 36*e* of grounding connector 22*e*. The protrusion 38*b* of grounding connector 22*b* is inserted into the recess 40*e* of grounding connector 22*e*. At the same time, the protrusion 38*e* of grounding connector 22*e* is inserted into the recess 40*b* of grounding connector 22*b*. As depicted in FIG. 6A, grounding connector 22*b* may then be slid in the direction of the arrow 62. FIG. 6B depicts the two grounding connectors 22*b*, 22*e* in a mated configuration. The protrusion 38*b* of grounding connector 22*b* completely resides in the recess 40*e* of grounding connector 22*e* and the protrusion 38*e* of grounding connector 22*e* completely resides in the recess 40*b* of the grounding connector 22*b*.

Figure 7A:
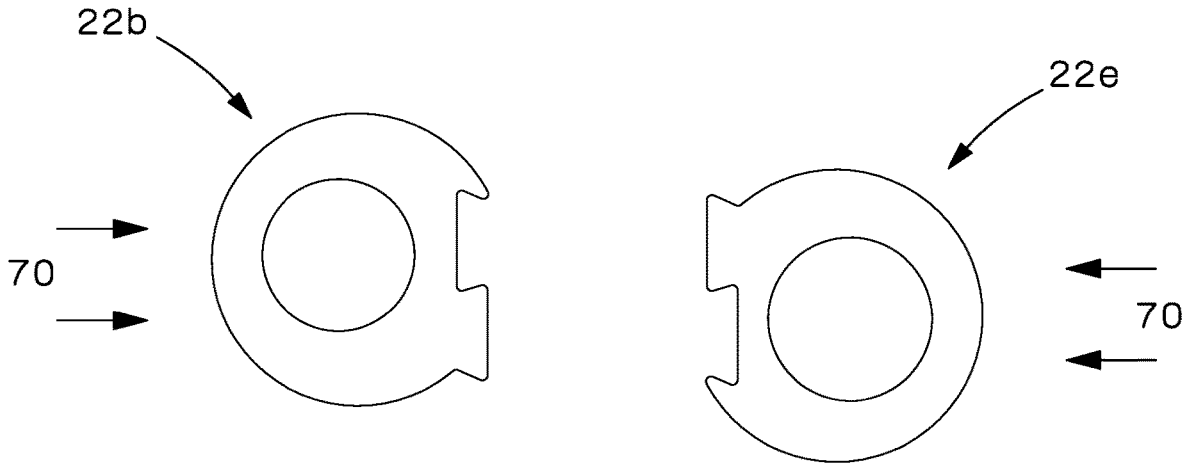
FIG. 7A depicts a top view of two grounding connectors being orientated for assembly.
Figure 7B:
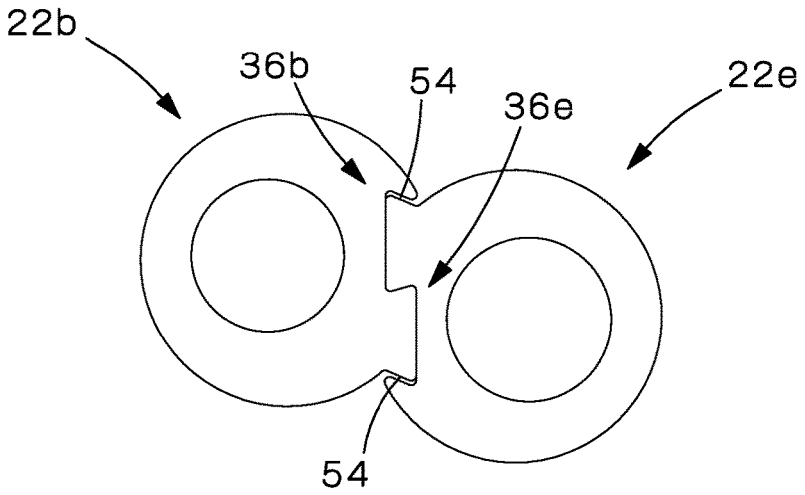
FIG. 7B depicts a top view of the grounding connectors of FIG. 7A in a mated configuration.
Figure 7C:
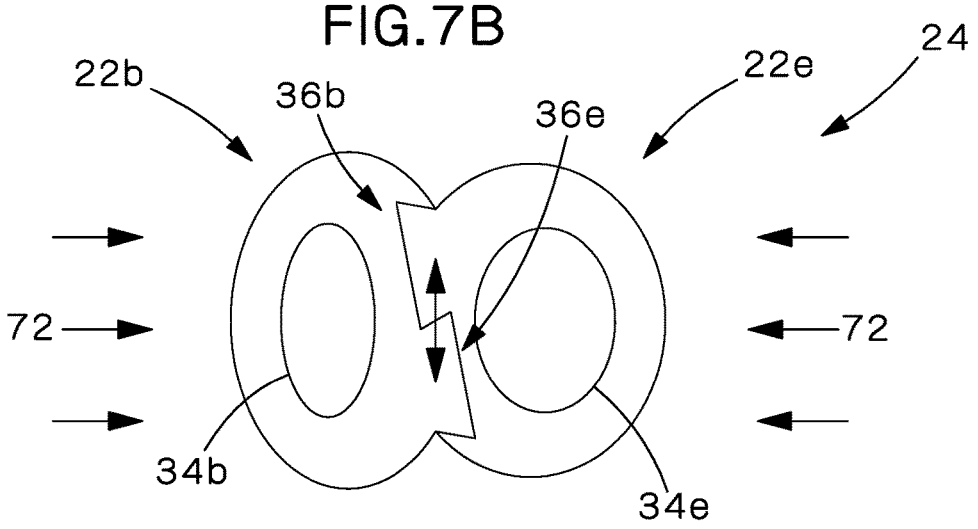
FIG. 7C depicts a top view of the grounding connectors of FIG. 7B in a crimped configuration.

FIGS. 7A-7C depict a top perspective of the process of mating the grounding connectors 22*b*, 22*e*. In FIG. 7A, the two grounding connectors 22*b*, 22*e* are orientated for mating as depicted by arrows 70. FIG. 7B depicts the grounding connectors 22*b*, 22*e* in a mated relationship prior to crimping as shown by the allowance 54 in the lock joints 36*b*, 36*e*. FIG. 7C depicts the grounding connectors 22*b*, 22*e* after crimping. Force 72 has been applied to the grounding connectors 22*b*, 22*e* in the direction of the arrows. The openings 34*b*, 34*e* have been deformed and are configured to affix a wire or rod installed within as described below in relation to FIGS. 9 and 10 below. Also depicted, the protrusion 38*b*, 38*e* of each grounding connector 22*b*, 22*e* is deformed outwardly in the direction of arrow 74 within the respective recess 40*b*, 40*e*. This deformation eliminates the allowance 54 of the lock joints 36*b*, 36*e* depicted in FIG. 7B. Accordingly, the lock joints 36*b*, 36*e* have been deformed to fix the grounding connectors 22*b*, 22*e* together to form a unitary grounding compression connector 24.

Figure 8A:
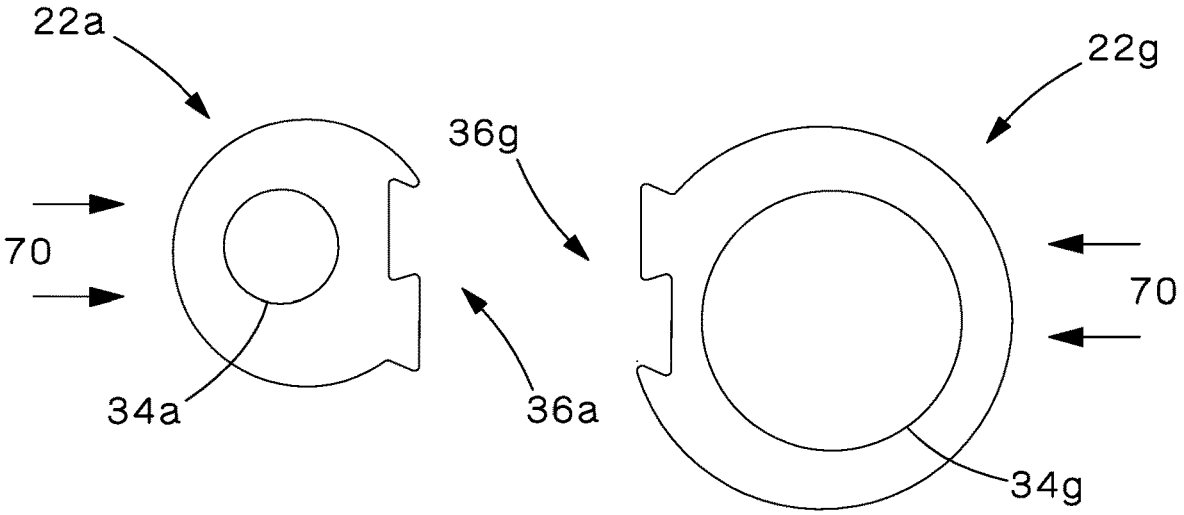
FIG. 8A depicts a top view of two grounding connectors being orientated for assembly.
Figure 8B:
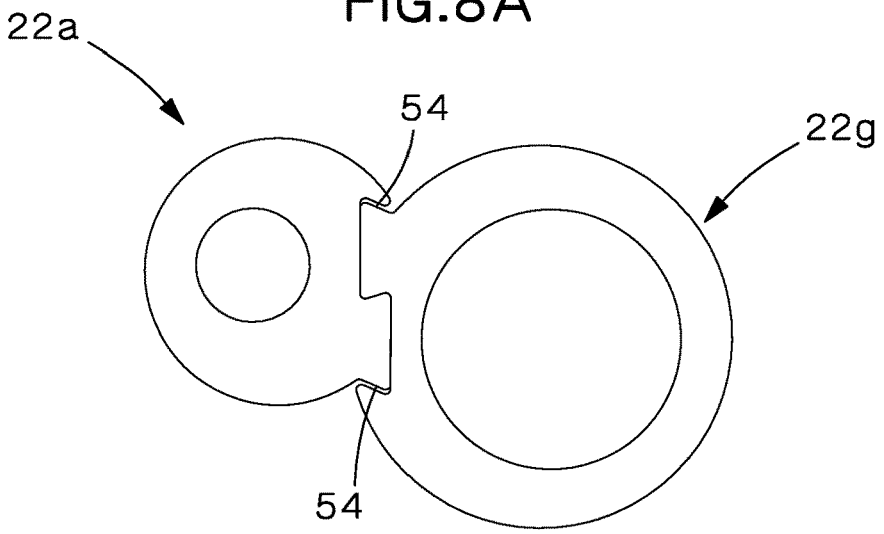
FIG. 8B depicts a top view of the grounding connectors of FIG. 8A in a mated configuration.
Figure 8C:
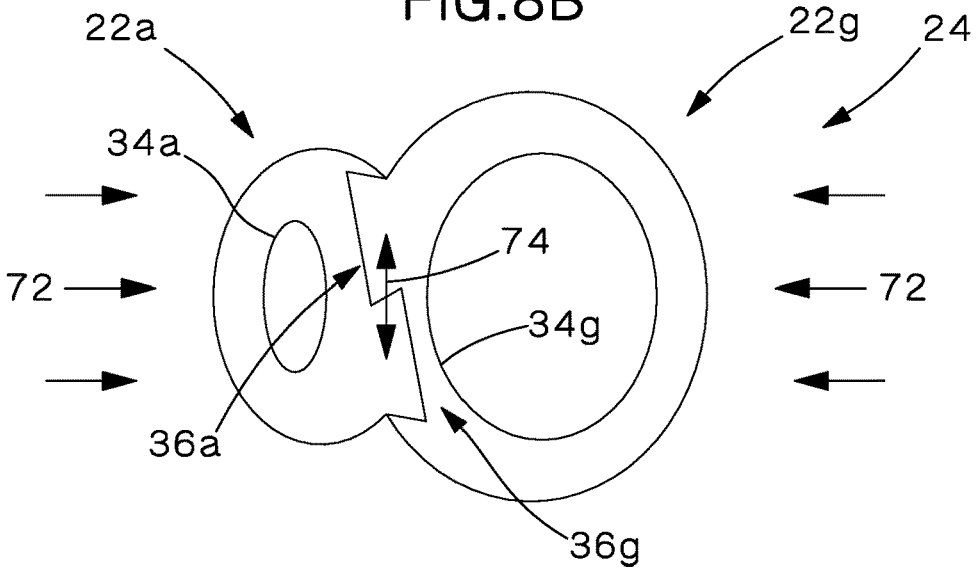
FIG. 8C depicts a top view of the grounding connectors of FIG. 8B in a crimped configuration.

FIGS. 8A-8C depict two significantly different sized grounding connectors 22*a*, 22*g* configured to be joined via the lock joints 36. As described above, the lock joint 36*a*, 22*g* of each of the grounding connectors 22*a*, 22*g* is configured such that the grounding connector 22*g* with a large diameter opening 34 may mate with the grounding connector 22*a* with a much smaller opening 34.

In FIG. 8A, the two grounding connectors 22*a*, 22*g* are orientated for mating as depicted by arrow 70. FIG. 8B depicts the grounding connectors 22*a*, 22*g* in a mated relationship prior to crimping, as shown by the allowances 54 in the lock joints 36*a*, 36*g*. FIG. 8C depicts the grounding connectors 22*a*, 22*g* after crimping. Force 72 has been applied to the grounding connectors 22*a*, 22*g* in the direction of the arrows. The openings 34*a*, 34*g* have been deformed to be elliptical in shape. This deformation reduces the diameter across at least a portion of the openings 34*a*, 34*g*.

Further, the lock joints 36*a*, 36*g* have been deformed to fix the grounding connectors 22*a*, 22*g* together to form a unitary grounding compression connector 24. The protrusion 38*a*, 38*g* of each grounding connector 22*a*, 22*g* is deformed outwardly in the direction of arrow 74 within the respective recess 40*a*, 40*g*. This deformation eliminates the allowances 54 of the lock joints 36*a*, 36*g* depicted in FIG. 8B, fixing the grounding connectors 22*a*, 22*g* together to form a unitary grounding compression connector 24.

Figure 9:
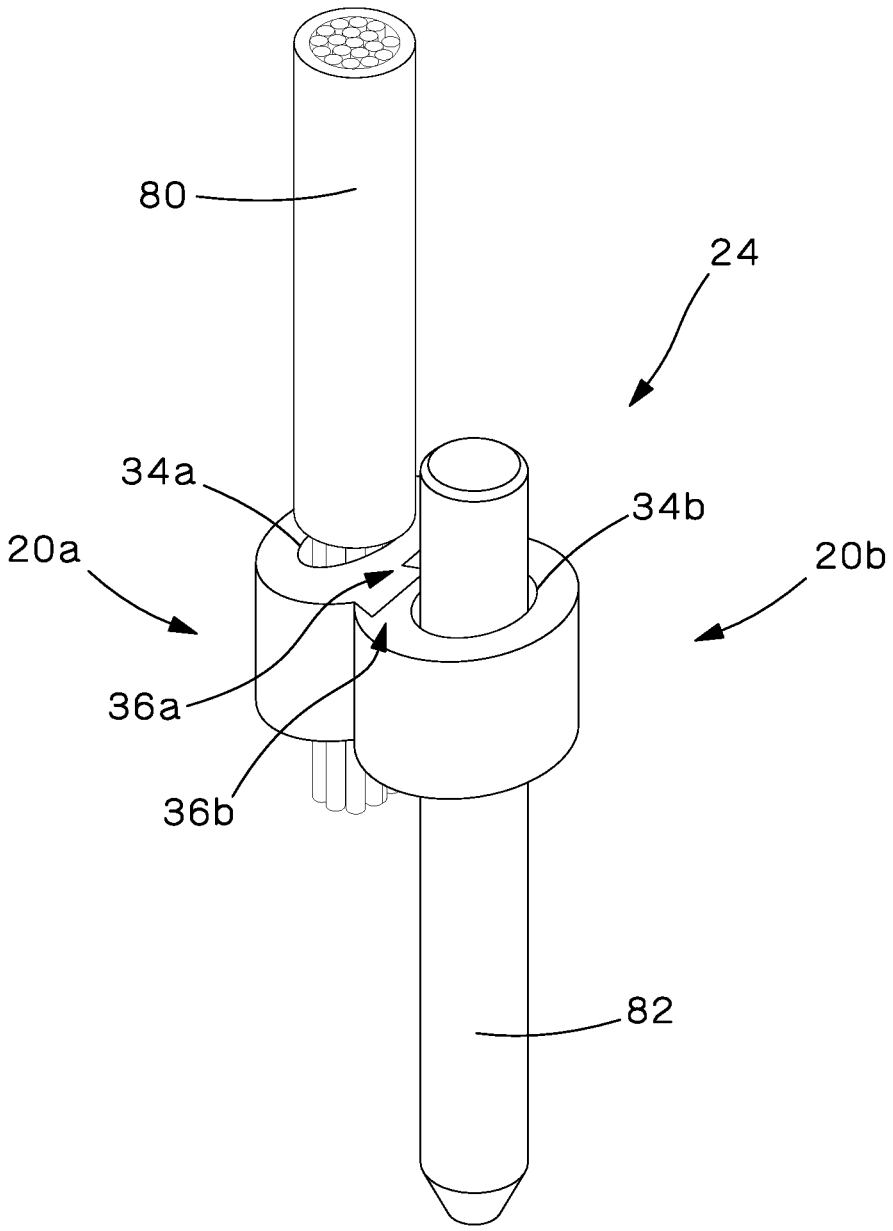
FIG. 9 depicts a top perspective view of two mated and crimped grounding connectors with a wire and rod installed therein.

FIG. 9 depicts a top isometric view of the grounding connectors 20*a*, 20*b* of FIGS. 3-5 with a wire 80 and grounding rod 82 installed therein. As depicted in FIG. 9, the wire 80 has been inserted into the opening 34*a* of grounding connector 20*a*. Further, the grounding rod 82 has been inserted into the opening 34*b* of grounding connector 20*b*. The grounding connectors 20*a*, 20*b* depicted in FIG. 9 have been crimped together to deform the openings 34*a*, 34*b*. The elliptical shape of the deformed openings 34*a*, 34*b* reduces the diameter across at least a portion of each of the openings 34*a*, 34*b*, thereby fixing the wire 80 and/or rod 82 in place within the respective grounding connector 20*a*, 20*b*.

The crimping of the grounding connector 20*a*, 20*b* also deforms the lock joints 36*a*, 36*b* as described above. As such, the grounding connectors 20*a*, 20*b* are fixed together as a unitary grounding compression connector 24.

Figure 10:
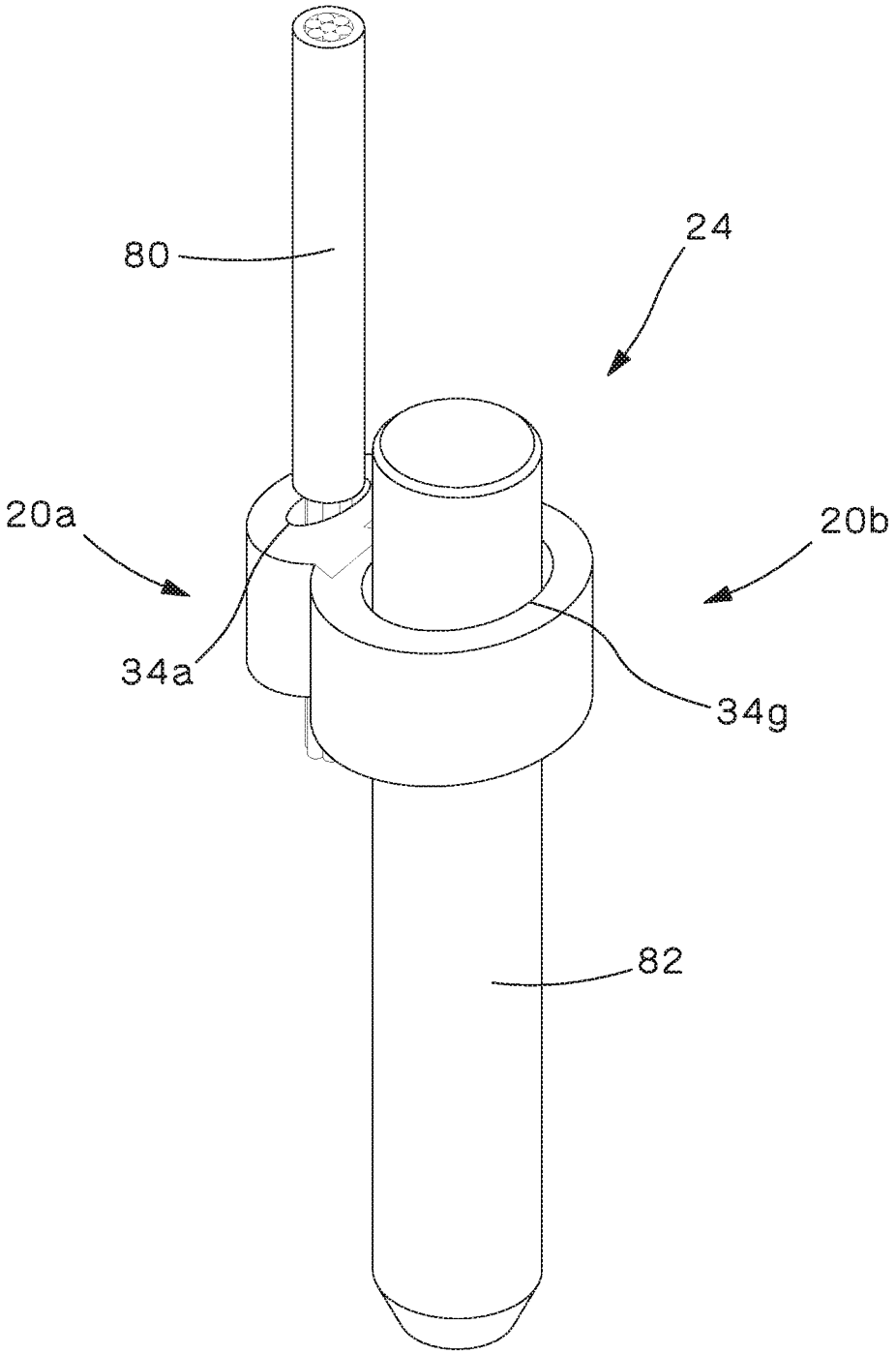
FIG. 10 depicts a top perspective view of another example of two mated and crimped grounding connectors with a wire and rod installed therein.

FIG. 10 depicts a top isometric view of the grounding connectors 22*a*, 22*g* from FIGS. 8A-8C. As described above, the grounding connectors 20*a*, 20*b* are fixed together as a unitary grounding compression connector 24 with the wire 80 and rod 82 affixed within the openings 34*a*, 34*g*.

Figure 11:
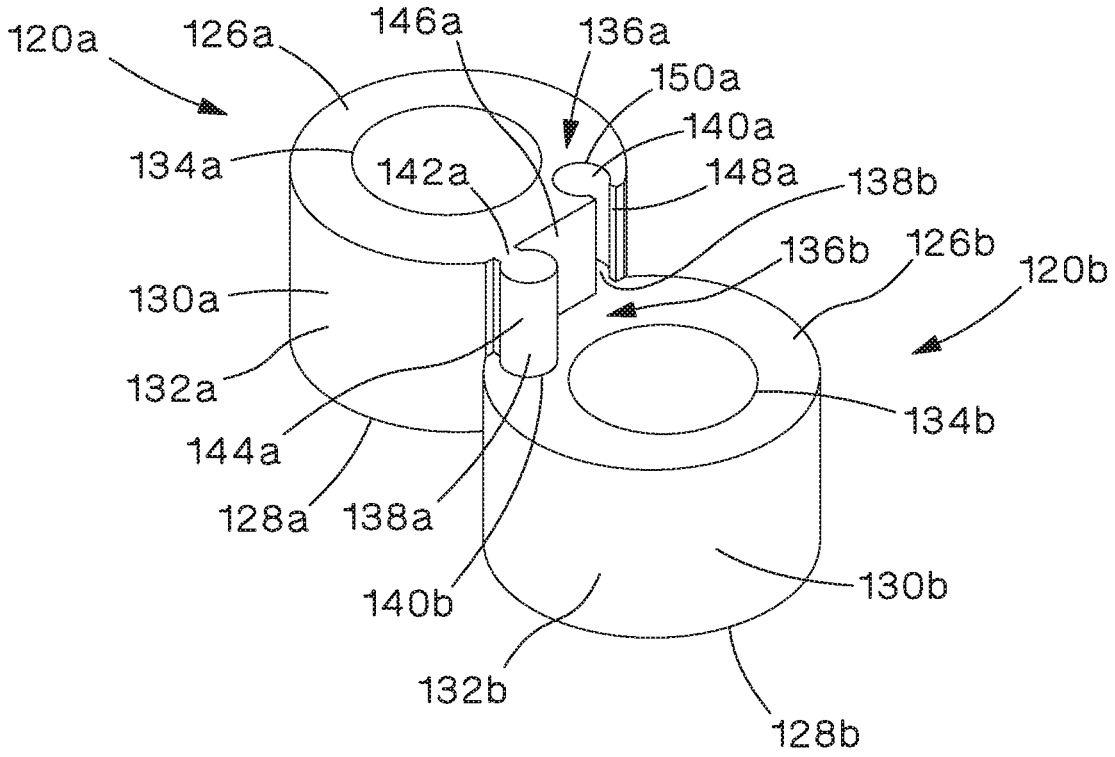
FIG. 11 depicts top perspective view of an alternative example of two grounding connectors in a slidable configuration.

FIG. 11 depicts another example of the present invention. FIG. 11 depicts grounding connectors 120*a*, 120*b*, which are similar to the above described grounding connectors. Grounding connectors 120*a*, 120*b* include a first side 126, second side 128, and side wall 130 that define the body 132 as provided above in the description directed to the first side 26, second side 28, side wall 30, and body 32 of grounding connectors 20*a*, 20*b*. Grounding connectors 120*a*, 120*b* also include an openings 134*a* and 134*b* as described above. The description of the grounding connectors provided above applies to the description of the grounding connectors 120*a*, 120*b* as described in this paragraph.

Grounding connectors 120*a*, 120*b* depicted in FIG. 11 further include lock joints 136*a*, 136*b*. Each lock joint 136*a*, 136*b* includes the combination of a protrusion 138*a*, 138*b* and adjacent recess 140*a*, 140*b*. The protrusion 138*a*, 138*b* and recess 140*a*, 140*b* are separated by an intermediary wall 146*a*, 146*b*. The protrusion 140*a*, 140*b* is disposed on the side wall 130*a*, 130*b* from the first side 126*a*, 126*b* to the second side 128*a*, 128*b*. The protrusion includes a stem 142*a*, 142*b* and a head 144*a*, 144*b*. The stem 142*a*, 142*b* may extend out from the side wall 130*a*, 130*b* at a right angle. The stem 142*a*, 142*b* has a rectangular cross-sectional shape. At an end of the stem 142*a*, 142*b* is the head 144*a*, 144*b*. The head 144*a*, 144*b* has a circular cross-sectional shape. The stem 142*a*, 142*b* offsets the head 144*a*, 144*b* away from the side wall 130*a*, 130*b*.

The recess 140*a*, 140*b* is a cut-out within the body 132*a*, 132*b* in the same cross-sectional configuration as the protrusion 138*a*, 138*b*. The recess 140*a*, 140*b* extends from the first side 126*a*, 126*b* to the second side 128*a*, 126*b* along the side wall 130*a*, 130*b*. The recess 140*a*, 140*b* includes a stem cut-out 148*a*, 148*b* and a head cut-out 150*a*, 150*b*. The stem cut-out 148*a*, 148*b* may extend into the body 132*a*, 132*b* from the side wall 130*a*, 130*b* at a right angle. The stem cut-out 148*a*, 148*b* has a rectangular cross-sectional shape. At an end of the stem cut-out 148*a*, 148*b* is the head cut-out 150*a*, 150*b*. The head cut-out 150*a*, 150*b* has a circular cross-sectional shape. The stem cut-out 148*a*, 148*b* offsets the head cut-out 150*a*, 150*b* away from the side wall 130*a*, 130*b*.

The shape and dimensions of the protrusion 138*a*, 138*b* are configured to correspond to the recess 140*a*, 140*b*. The size and shape of the protrusion 138*a*, 138*b* is configured to be slightly smaller than the size and shape of the recess 140*a*, 140*b* of the grounding connectors 120*a*, 120*b*. The shape and size relationship between the protrusion 138*a*, 138*b* and recess 140*a*, 140*b* facilitate on the grounding connectors 120*a*, 120*b* is such that the grounding connector is symmetrical and may mate with other grounding connectors with the same lock joint 136*a*, 136*b* configuration as depicted in FIG. 11.

Figure 12:
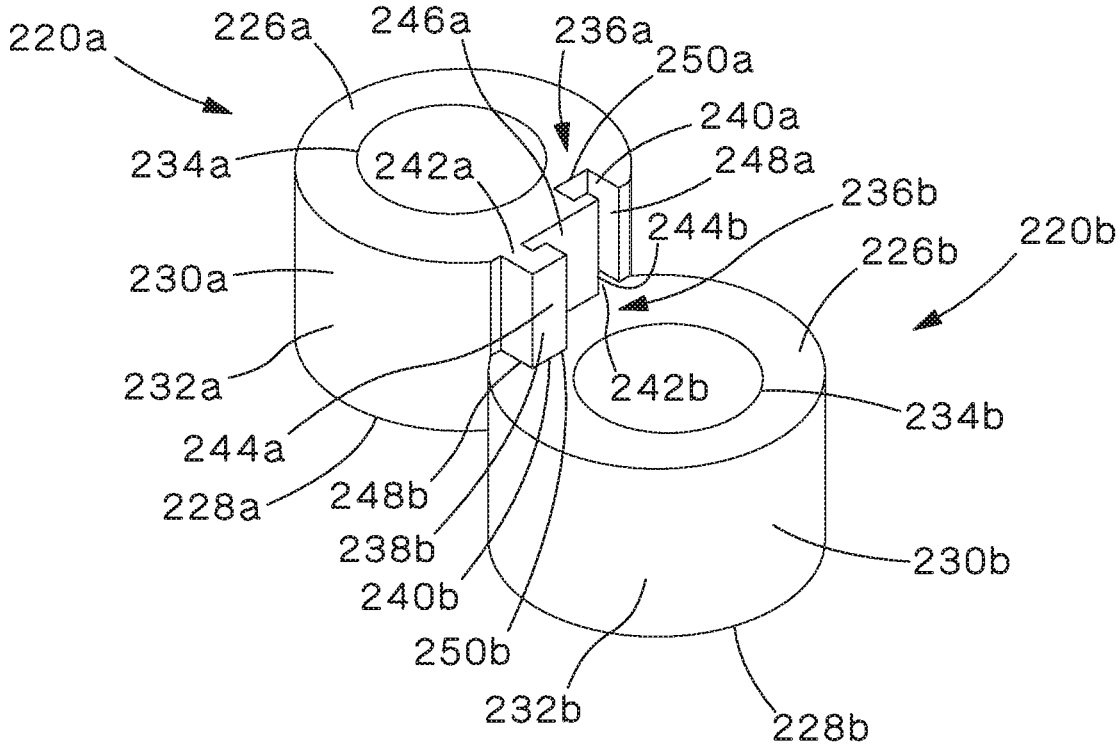
FIG. 12 depicts a top perspective view of a further alternative example of two grounding connectors in a slidable configuration.

FIG. 12 depicts a further example of the present invention. FIG. 12 depicts grounding connectors 220*a*, 220*b*, which are similar to the above described grounding connectors. Grounding connectors 220*a*, 220*b* include a first side 226*a*, 226*b*, second side 228*a*, 228*b*, and side wall 230*a*, 230*b* that define the body 232*a*, 232*b* as provided above in the description directed to the first side 26*a*, 26*b*, second side 28*a*, 28*b*, side wall 30*a*, 30*b*, and body 32*a*, 32*b* of grounding connectors 20*a*, 20*b*. Grounding connectors 220*a*, 220*b* also include an opening 234*a*, 234*b* as described above. The description of the grounding connectors provided above relates to the description of the grounding connectors 220*a*, 220*b* as described in this paragraph.

Grounding connectors 220*a*, 220*b* depicted in FIG. 12 further include lock joints 236*a*, 236*b*. The lock joint 236*a*, 236*b* includes the combination of a protrusion 238*a*, 238 and adjacent recess 240*a*, 240*b*. The protrusion 238*a*, 238*b* and recess 240*a*, 240*b* are separated by an intermediary wall 246*a*, 246*b*.

The protrusion 238*a*, 238*b* is disposed on the side wall 230*a*, 230*b* from the first side 226*a*, 226*b* to the second side 228*a*, 228*b*. The protrusion 228*a*, 228*b* is L-shaped. The protrusion includes a stem 242*a*, 242*b* and a head 244*a*, 244*b*. The stem 242*a*, 242*b* offsets the head 244*a*, 244*b* away from the side wall 230*a*, 230*b*. The stem 242*a*, 242*b* may extend out from the side wall 226*a*, 226*b* at a right angle. The stem cut 242*a*, 242*b* has a rectangular cross-sectional shape. At an end of the stem 242*a*, 242*b* is the head 244*a*, 244*b*. The head 244*a*, 244*b* extends across a portion of the intermediary wall 246*a*, 246*b* towards the recess. The head 244*a*, 244*b* has a rectangular shaped cross-section.

The recess 240*a*, 240*b* is a cut-out within the body 232*a*, 232*b* in the same cross-sectional configuration as the protrusion 238*a*, 238*b*. The recess 240*a*, 240*b* extends from the first side 226*a*, 226*b* to the second side 228*a*, 228*b* along the side wall 230*a*, 230*b*. The recess 240*a*, 240*b* includes a stem cut-out 248*a*, 248*b* and a head cut-out 250*a*, 250*b*. The stem cut-out 248*a*, 248*b* may extend into the body 232*a*, 232*b* from the side wall 226*a*, 226*b* at a right angle. The stem cut-out 248*a*, 248*b* has a rectangular cross-sectional shape. At an end of the stem 242*a*, 242*b* is the head cut-out 250*a*, 250*b*. The head cut-out 250*a*, 250*b* has a rectangular cross-sectional shape. The stem cut-out 248*a*, 248*b* offsets the head cut-out 250*a*, 250*b* away from the side wall 230*a*, 230*b*.

The shape and dimensions of the protrusion 238*a*, 238*b* are configured to correspond to the recess 240*a*, 240*b*. The size and shape of the protrusion 238*a*, 238*b* is configured to be slightly smaller than the size and shape of the recess 240*a*, 240*b* of the grounding connectors 220*a*, 220*b*. The shape and size relationship between the protrusion 238*a*, 238*b* and recess 240*a*, 240*b* facilitate on the grounding connectors 220*a*, 220*b* is such that the grounding connector is symmetrical and may mate with other grounding connectors with the same lock joint 236*a*, 236*b* configuration as depicted in FIG. 12.

The grounding connector of the present invention may be constructed of electrically conductive material, such as copper. However, it is likewise contemplated that the grounding connector may be made of any suitable material or element that will withstand a crimping operation.

The illustrations of the embodiments described herein are intended to provide a general understanding of the structure of the various examples. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

We claim:

1. A grounding connector comprising:

a body including a first side and a second side and a mid-section extending therebetween, wherein an opening extends through the body from the first side to the second side to form a passage surrounded by the body, and wherein the body includes a lock joint configured to join the grounding connector with a second grounding connector, the lock joint including a recess inset into the mid-section of the body and a protrusion adjacent the recess extending from the mid-section.

2. The grounding connector of claim 1, wherein the lock joint is configured to slidably connect to the second grounding connector.

3. The grounding connector of claim 1, wherein the opening is configured to accept a wire or a rod to pass through the passage.

4. The grounding connector of claim 3, wherein the grounding connector is configured to deform and reduce a diameter across at least a portion of the passage along a distance spanning from the first side to the second side for securing the wire or rod therein.

5. The grounding connector of claim 1, wherein the protrusion includes a first outer wall extending from the body, an inner wall extending from the body, and a first base wall extending therebetween, where a first distance between the first outer wall and the inner wall along the base wall is greater than a second distance between the first outer wall and the inner wall along the body.

6. The grounding connector of claim 5, wherein the recess includes a second outer wall extending into the body, the inner wall of the protrusion, and a second base wall extending therebetween, where a third distance between the second outer wall and the inner wall along the second base wall is greater than a fourth distance between the second outer wall and the inner wall along adjacent the second base wall.

7. A compression connector comprising:

a first grounding connector including a body including a first side and a second side and a mid-section extending therebetween, wherein an opening extends through the body from the first side to the second side to form a passage surrounded by the body, and wherein the body includes a first lock joint; and a second grounding connector including a body including a first side and a second side and a mid-section extending therebetween, wherein an opening extends through the body from the first side to the second side to form a passage surrounded by the body, and wherein the body includes a second lock joint;

wherein the first lock joint of the first grounding connector is removably mated to the second lock joint of the second grounding connector.

8. The compression connector of claim 7, wherein a diameter of the opening of the first grounding connector is larger than a diameter of the opening of the second grounding connector.

9. The compression connector of claim 7, wherein the first and second lock joints include a protrusion and a recess.

10. The compression connector of claim 9, wherein the protrusion of the first lock joint extends out from the body of the first grounding connector, the recess of the first lock joint resides within the body of the first grounding connector, the protrusion of the second lock joint extends out from the body of the second grounding connector, and the recess of the second lock joint resides within the body of the second grounding connector.

11. The compression connector of claim 7, wherein the first lock joint and the second lock joint are configured to slidably mate with each other.

12. The compression connector of claim 7, wherein the first lock joint of the first grounding connector includes a first recess inset into the mid-section of the body of the first grounding connector and a first protrusion adjacent the first recess extending from the mid-section.

13. The compression connector of claim 12, wherein the second lock joint of the second grounding connector includes a second recess inset into the mid-section of the body of the second grounding connector and a second protrusion adjacent the second recess extending from the mid-section.

14. The compression connector of claim 13, wherein the first protrusion and second protrusion each include a first outer wall extending from their respective body, an inner wall extending from their respective body, and a first base wall extending therebetween, where a first distance between the first outer wall and the inner wall along the first base wall is greater than a second distance between the outer wall and the inner wall along adjacent a second base wall.

15. The compression connector of claim 14, wherein the first recess and second recess each include a second outer wall extending into the body, the inner wall of the protrusion, and the second base wall extending therebetween, where a third distance between the second outer wall and the inner wall along the second base wall is greater than a fourth distance between the second outer wall and the inner wall along the body.

16. A method of forming a compression connector, the method comprising:

joining a first lock joint of a first grounding connector to a second lock joint of a second grounding connector;

inserting a wire into an opening in the first grounding connector, wherein the opening extends from a first side of the first grounding connector to a second side of the first grounding connector to form a passage surrounded by a body of the first grounding connector;

inserting a grounding rod into an opening in the second grounding connector, wherein the opening extends from a first side of the second grounding connector to a second side of the second grounding connector to form a passage surrounded by a body of the second grounding connector;

crimping the joined first grounding connector and second grounding connector;

deforming the first grounding connector at a position along the passage of the first grounding connector; and deforming the second grounding connector at a position along the passage of the second grounding connector.

* * * * *